United States Patent [19]

Collier

[11] 4,283,846

[45] Aug. 18, 1981

[54] ELECTRICAL TERMINAL CRIMPING APPARATUS

[75] Inventor: John C. Collier, York, Pa.

[73] Assignee: BICC Limited, London, England

[21] Appl. No.: 71,538

[22] Filed: Aug. 31, 1979

[30] Foreign Application Priority Data

Sep. 4, 1978 [GB] United Kingdom ..... 35512/78

[51] Int. Cl.[3] ..... H01R 43/04

[52] U.S. Cl. ..... 29/753; 29/566.2; 29/759; 72/345; 72/427

[58] Field of Search ..... 29/753, 759, 566.2, 29/564.4, 564.6; 72/345, 427

[56] References Cited

U.S. PATENT DOCUMENTS

| | | | |
|---|---|---|---|
| 3,804,603 | 4/1974 | Wion | 29/566.2 X |
| 4,089,405 | 5/1978 | Loomis et al. | 29/753 X |
| 4,114,253 | 9/1978 | Loomis et al. | 29/566.2 |

*Primary Examiner*—Carl E. Hall

*Attorney, Agent, or Firm*—Buell, Blenko, Ziesenheim & Beck

[57] ABSTRACT

In electrical terminal crimping apparatus comprising two crimping dies so mounted that one die is constrained to move towards and away from the other die, a wheel having circumferentially spaced, outwardly extending vanes is rotatably mounted with respect to the dies and a pawl, operatively connected to the movable die, is adapted to engage a ratchet, carried by the wheel, to effect partial rotation of the wheel. After a terminal has been crimped to an electrical lead and as the movable die moves away from the fixed die, the pawl automatically engages the ratchet and causes the wheel to rotate so that a vane pushes the terminated lead laterally from between the dies to a sufficient extent to permit the stripped end of another lead to be positioned between the dies.

10 Claims, 2 Drawing Figures

ELECTRICAL TERMINAL CRIMPING APPARATUS

This invention relates to electrical terminal crimping apparatus by means of which an electrical terminal is secured to a stripped end of a length of flexible insulated conductor (hereinafter, for convenience, referred to as an electrical lead) by a crimping operation.

In a known kind of electrical terminal crimping apparatus a strip of electrical terminals is fed automatically through the apparatus and, each time the apparatus is actuated by an operator, the leading terminal of the strip is simultaneously severed from the strip and crimped to a stripped end of an electrical lead positioned by the operator between crimping dies of the apparatus. To achieve a high rate of production of terminated electrical leads, a high degree of dexterity is required by the operator. Usually, the operator holds a bunch of electrical leads in one hand and, for each electrical lead in turn, the operator withdraws the electrical lead from the bunch, positions a stripped end of the lead between the crimping dies of the apparatus, actuates the crimping apparatus to cause it simultaneously to sever the leading terminal from the strip and to crimp it to the stripped end of the lead, and then moves the terminated end of the lead from between the crimping dies before positioning between the dies another electrical lead from the bunch. Manipulation of an electrical lead by the operator occupies a major proportion of the complete time cycle of securing an electrical terminal to the lead. For example, although a known form of electrical terminal crimping apparatus is capable of 13,500 crimping operations per hour, when electrical leads are fed in turn to the apparatus by an operator the number of electrical leads terminated by the apparatus per hour seldom exceeds 2000; that is to say, the apparatus is operating at only approximately 15% of its optimum rate. The dexterity of an operator in manipulating electrical leads is therefore a major factor in the efficiency of the terminating operation.

Where safety regulations require the provision of a guard around the crimping dies of the apparatus, the situation is aggravated because, in this case, in order to introduce a stripped end of an electrical lead between crimping dies, the operator has first to insert the lead through an aperture in the guard and, in order to move a terminated lead from between the crimping dies, the operator has to guide the terminated lead from the aperture along a slot in the guard. Thus, where a guard is employed, manipulation of electrical leads during the complete terminating cycle is more difficult and the efficiency of the terminating operation is inevitably further reduced.

We have found that a major proportion of the time employed in manipulating an electrical lead during a terminating cycle is taken in moving a terminated lead from between the crimping dies to a sufficient extent to permit another lead to be positioned between the dies because it is difficult for an operator to move the terminated lead from between the dies and position another lead between the dies at one and the same time.

It is an object of the present invention to provide, for use in crimping an electrical terminal to a stripped end of an electrical lead, improved electrical crimping apparatus which can be operated more efficiently than crimping apparatus hitherto proposed.

According to the present invention, the improved apparatus comprises at least two crimping dies so mounted that at least one of the dies is constrained to move towards and away from the other die, wherein the movable die or at least one of the movable dies has operatively connected to the die, means for guiding a terminated electrical lead laterally from between the dies, the arrangement being such that, as said movable die travels away from the other die after an electrical terminal has been crimped to a stripped end of an electrical lead, said guide means is automatically actuated to move the terminated electrical lead laterally from between the dies to a sufficient extent to permit the stripped end of another lead to be positioned between the dies.

Preferably, the lead-guide means comprises a wheel which has a number of circumferentially spaced, outwardly extending vanes and which is rotatably mounted with respect to the crimping dies and wheel-engaging means for effecting at least partial rotation of the wheel, the arrangement being such that, after an electrical terminal has been crimped to a stripped end of an electrical lead and as the movable die or one of the movable dies travels away from the other die, said wheel-engaging means causes the wheel to rotate to such an extent that one of the vanes will push the terminated lead laterally from between the crimping dies.

Rotation of the wheel is preferably effected by means of a pawl and ratchet mechanism, the ratchet being carried on the wheel and the pawl constituting the wheel-engaging means which will effect at least partial rotation of the wheel. The pawl may be carried by the movable die or one of the movable dies in such a way that it will engage the ratchet and effect rotational movement of the wheel as said movable die travels away from the other die or it may be carried on a spring-loaded plunger which will be depressed by the movable die or one of the movable dies as the die travels towards the other die and which, when the die travels away from the other die, will be released under the action of its spring to cause the pawl to engage the ratchet and effect at least partial rotation of the wheel.

The wheel may be rotatably mounted on the crimping apparatus itself or, where a guard is provided, on the inner or outer surface of the guard. Where the crimping apparatus comprises two crimping dies, one of which is fixed and the other of which is positioned substantially vertically above, and is constrained to move vertically towards and away from, the fixed die, the wheel may be mounted above or below the crimping station bounded by the dies and the pawl and ratchet mechanism may be arranged to rotate the wheel in a clockwise or anti-clockwise direction depending upon in which lateral direction it is desired to move terminated leads.

The circumferential spacing of the vanes, the width of each vane and the extent of rotational movement of the wheel caused as said movable die travels away from the other die will be such that, after a vane of the wheel has moved a terminated lead laterally from between the crimping dies, positioning of the next electrical lead between the crimping dies will not be impeded or obstructed by a succeeding vane.

Preferably, and especially in the case when a guard is provided and each terminated lead has to be moved along a slot in the guard, each vane is so shaped that at any time the part of the vane engaging a terminated lead lies in a plane which is substantially normal to the direction of movement of the terminated lead. Where, as is preferred, the movable die reciprocates in a substantially vertical direction and each terminated lead is to be moved laterally from between the crimping dies in a substantially horizontal direction, preferably that surface of each vane that engages terminated leads is of generally arcuate shape so that at any position along the slot in the guard, the part of the surface of the vane engaging a lead will be substantially vertical and the terminated lead will be pushed in a horizontal direction as the wheel rotates.

For convenience, the wheel, the ratchet and the associated vanes may be a single moulded body of plastics material. A ratchet may be provided on both faces of the wheel so that, where the vanes are of arcuate shape, the wheel is suitable for mounting above or below the crimping station and for being rotatably driven in a clockwise or anti-clockwise direction.

The rotatably mounted wheel with circumferentially spaced vanes and its associated operating mechanism is cheap and simple to manufacture and can be incorporated in known forms of electrical lead crimping apparatus at low cost.

The invention is further illustrated by a description, by way of example, of two preferred devices for automatically moving a terminated electrical lead laterally from between the crimping dies of electrical lead crimping apparatus, with reference to the accompanying drawings which show front elevations of the two devices.

Figure 1:
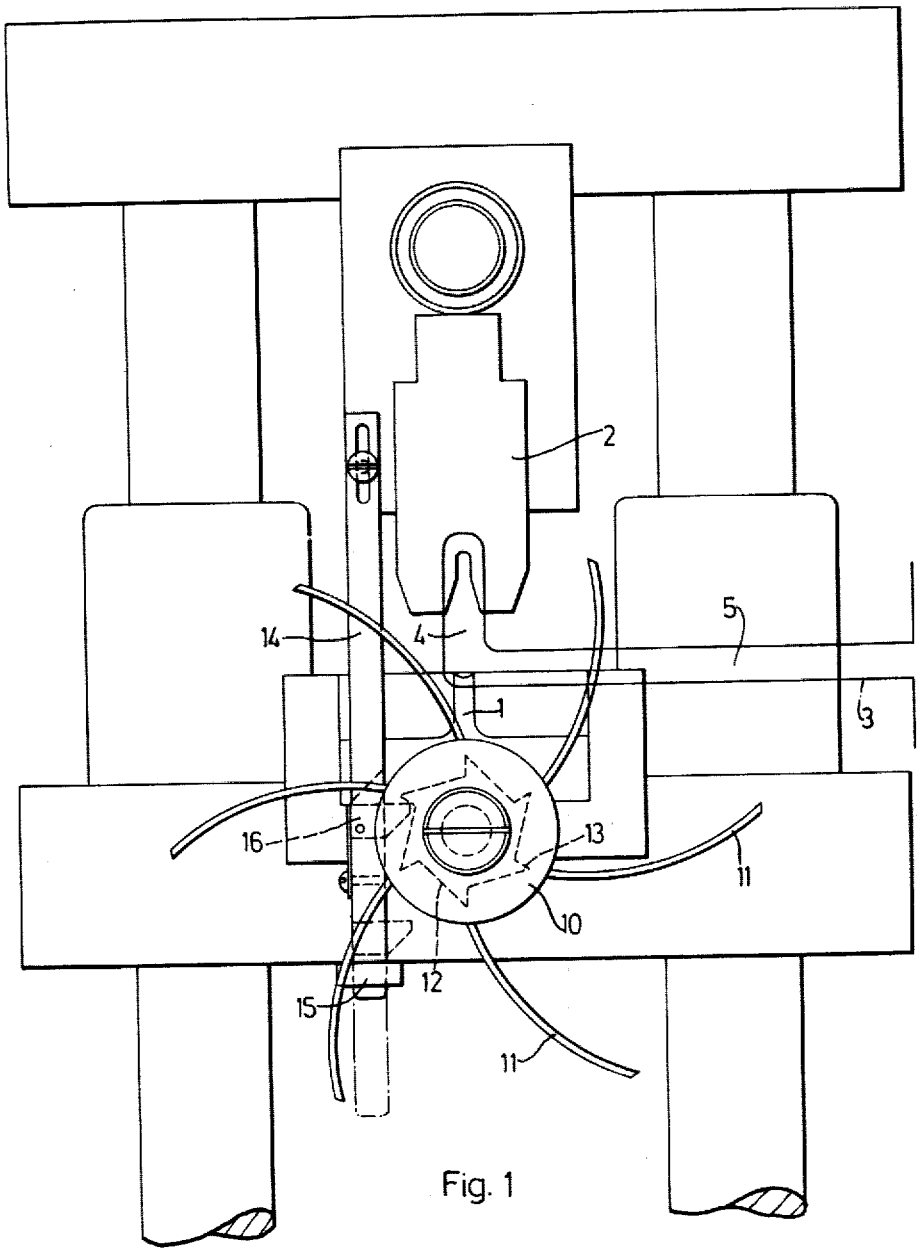
FIG. 1 is a front elevation of one embodiment of this invention.

The electrical lead crimping apparatus with which each device is associated comprises a pair of crimping dies 1, 2 to which a strip of electrical terminals is fed from a source of supply (not shown). The crimping die 1 is fixed and constitutes a support table for the leading terminal of the strip and for the stripped end of an electrical lead to which the terminal is to be crimped. The crimping die 2 reciprocates in a vertical direction under the action of a pneumatically controlled piston (not shown), when the apparatus is actuated by an operator. The dies 1, 2 are surrounded by a guard 3 of transparent plastics material having an aperture 4 through which a stripped end of an electrical lead is introduced for positioning between the dies and a horizontal slot 5 along which leads are moved after they have been terminated.

The device shown in FIG. 1 comprises a plastics wheel 10 which is rotatably mounted on the crimping apparatus below the crimping station with its axis substantially horizontal and which has six circumferentially spaced, outwardly extending vanes 11 of arcuate shape. The wheel 10 carries a ratchet 12 which has six teeth 13, one tooth being associated with each vane 11. A rod 14 is adjustably mounted on the movable die 2 and extends downwardly through a guide 15. Pivotally mounted on the rod 14 is a spring-loaded pawl 16.

When an operator has inserted a stripped end of an electrical lead through the aperture 4 in the guard 3 and has actuated the crimping apparatus, the die 2 travels downwardly to crimp the leading terminal of the strip on the stripped end of the lead. At the same time, the rod 14 is pushed through the guide 15, the pawl 16 being tripped so that it does not effect rotation of the wheel 10. On completion of the crimping operation, the movable die 2 travels upwardly from the die 1 carrying with it the rod 14. As the rod 14 moves upwardly, the pawl 16 engages a tooth 13 of the ratchet 12 to cause the wheel 10 to rotate clockwise for approximately a sixth of its circumference. As the wheel 10 rotates, a vane 11 engages the terminated lead and pushes it along the slot 5 in the guard 3 and clear of the die 1 so that the operator can position a stripped end of another electrical lead into the crimping apparatus. This sequence is repeated for each electrical lead.

Figure 2:
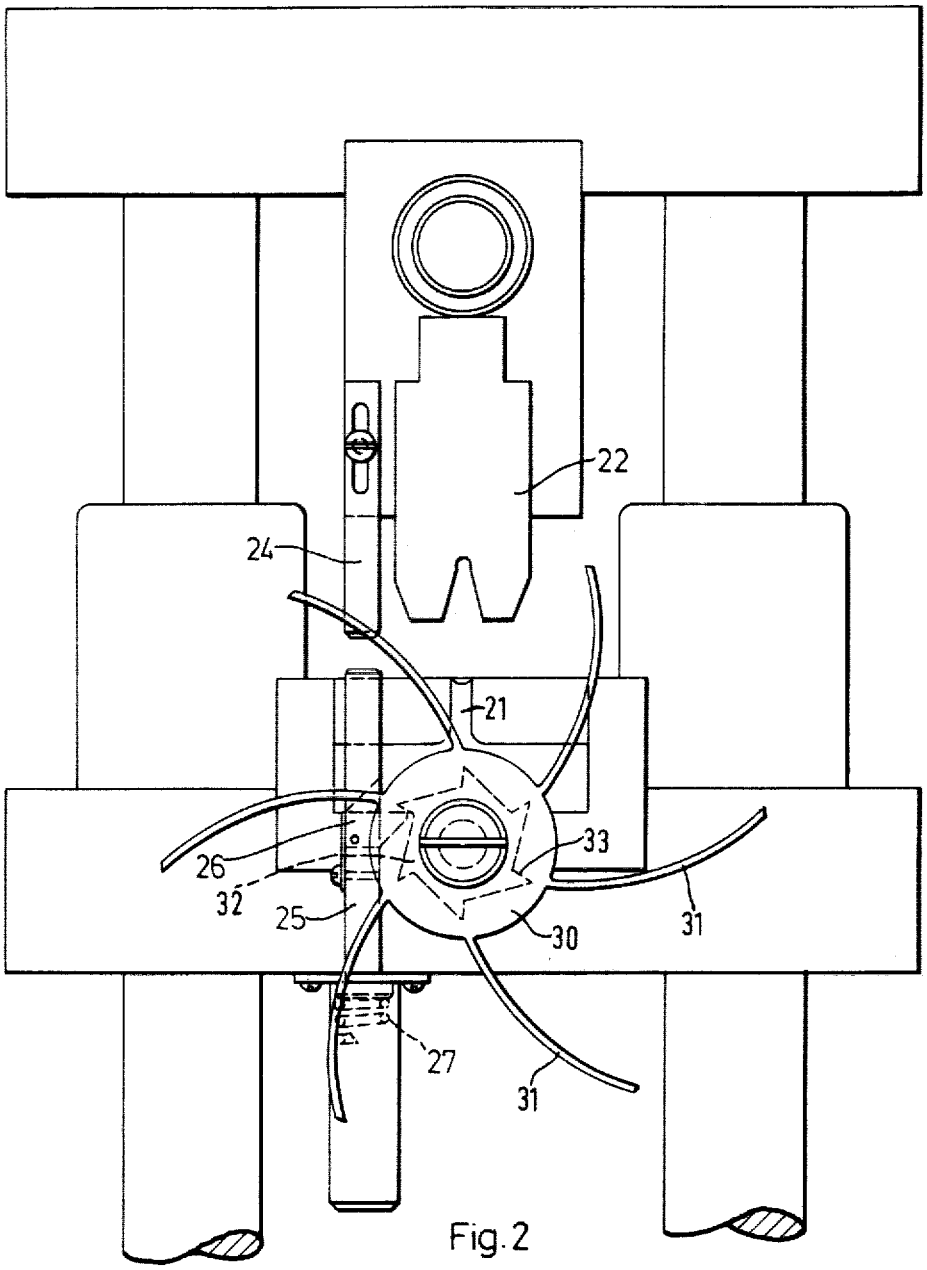
FIG. 2 is a front elevation of a second embodiment of this invention.

The device shown in FIG. 2 comprises a plastics wheel 30 of the same form as that shown in FIG. 1, but the operating mechanism of the wheel differs. Mounted alongside wheel 30 is a spring-loaded plunger 25 on which is pivotally mounted a spring-loaded pawl 26. A rod 24 is adjustably mounted on the movable die 22 directly above the plunger 25.

When the crimping apparatus is actuated to crimp an electrical terminal on the stripped end of an electrical lead positioned on the die 21, the movable die 22 travels downwardly and at the same time, the rod 24 engages the plunger 25 and pushes it downwardly against the action of its spring 27, the pawl 26 being tripped to ensure that it does not effect rotation of the wheel 30. After the crimping operation has been effected, the movable die 22 travels upwardly carrying with it the rod 24 and, at the same time, the plunger 25 is urged upwardly by its spring 27 so that the pawl 26 engages one of the teeth 33 of the ratchet 32 to cause the wheel to rotate clockwise for approximately a sixth of its circumference. As the wheel 30 rotates a vane 31 pushes the terminated lead laterally from between the dies 21,22. This sequence is repeated for each electrical lead.

Since each device automatically moves a terminated lead from between the crimping dies of the crimping apparatus and thereby leaves an operator free to position another electrical lead between the dies as soon as the terminated lead has been moved, the proportion of the complete time cycle occupied by manipulation of electrical leads by an operator is substantially reduced. Use of each of the devices illustrated in FIGS. 1 and 2 in existing electrical lead crimping apparatus when electrical leads are fed to the apparatus by an operator, will at least double the number of electrical leads that can be terminated by the apparatus per hour.

What I claim as my invention is:

1. For use in crimping an electrical terminal to a stripped end of an electrical lead, electrical crimping apparatus comprising at least two crimping dies so mounted that at least one of the dies is contrained to move towards and away from the other die, wherein a wheel having a number of circumferentially spaced, outwardly extending vanes is rotatably mounted with respect to the crimping dies and wheel-engaging means for effecting at least partial rotation of the wheel is operatively connected to the movable die, the arrangement being such that, after an electrical terminal has been crimped to a stripped end of an electrical lead and as said movable die travels away from the other die, said wheel-engaging means automatically causes the wheel to rotate to such an extent that one of the vanes will push the terminated lead laterally from between the crimping dies to a sufficient extent to permit the stripped end of another lead to be positioned between the dies.

2. Electrical crimping apparatus as claimed in claim 1, wherein the wheel carries a ratchet and the wheel-engaging means is a pawl which will effect at least partial rotation of the wheel.

3. Electrical crimping apparatus as claimed in claim 2 where the pawl is carried by the movable die in such a way that the pawl will engage the ratchet and effect rotational movement of the wheel as the movable die travels away from the other die.

4. Electrical crimping apparatus as claimed in claim 2, wherein the pawl is carried on a spring-loaded plunger which will be depressed by the movable die as the die travels towards the other die and which, when the die travels away from the other die, will be released under the action of its spring to cause the pawl to engage the ratchet and effect at least partial rotation of the wheel.

5. Electrical crimping apparatus as claimed in claim 2, wherein the wheel, the ratchet and the associated vanes are a single moulded body of plastics material.

6. Electrical crimping apparatus as claimed in claim 2, in which two crimping dies are provided, one of which is fixed and the other of which is positioned substantially vertically above, and is constrained to move vertically towards and away from, the fixed die, wherein the wheel is mounted above or below the crimping station bounded by the dies and the pawl and ratchet mechanism is arranged to rotate the wheel in a rotational direction appertaining to the lateral direction it is desired to move terminated leads.

7. Electrical crimping apparatus as claimed in claim 6, wherein that surface of each vane of the wheel that engages terminated leads is of generally arcuate shape so that the part of the surface of the vane engaging a lead will be substantially vertical and the terminated lead will be pushed in a substantially horizontal direction as the wheel rotates.

8. Electrical crimping apparatus as claimed in claim 6, in which a guard is provided around the crimping station bounded by the crimping dies, wherein the guard has an aperture through which a lead to be terminated can be introduced for positioning in the crimping station and, extending laterally from the aperture, a slot along which each terminated lead can be pushed by a vane on the wheel when it is caused to rotate.

9. Electrical crimping apparatus as claimed in claim 8, wherein the wheel is rotatably mounted on the guard.

10. Electrical crimping apparatus as claimed in claim 1, wherein each vane on the wheel is so shaped that at any time the part of the vane engaging a terminated lead lies in a plane which is substantially normal to the direction of movement of the terminated lead.

* * * * *